United States Patent [19]

Zurbrigg et al.

[11] 4,106,120

[45] Aug. 15, 1978

[54] REVERSIBLE SURGICAL GOWN

[75] Inventors: Charles Edward Zurbrigg, London; William Douglas Sulman Keenan, Komoka, both of Canada

[73] Assignee: Lac-Mac Limited, London, Canada

[21] Appl. No.: 832,571

[22] Filed: Sep. 12, 1977

Related U.S. Application Data

[63] Continuation-in-part of Ser. No. 625,229, Oct. 23, 1975, abandoned.

[30] Foreign Application Priority Data

Mar. 24, 1975 [CA] Canada ..... 222941

[51] Int. Cl.[2] ..... A41D 13/00

[52] U.S. Cl. ..... 2/51; 2/DIG. 2

[58] Field of Search ..... 2/46, 48, 49 R, 51, 2/69, 69.5, 74, 83, 108, 114, DIG. 2, DIG. 6, DIG. 7; 128/132 D, 133

[56] References Cited

U.S. PATENT DOCUMENTS

| | | | |
|---|---|---|---|
| 1,178,701 | 4/1916 | Barker | 2/87 |
| 2,425,402 | 8/1947 | Sieloff | 2/DIG. 2 |
| 3,144,661 | 8/1964 | Buser | 2/114 |
| 3,609,767 | 10/1971 | Grosz | 2/114 |
| 3,803,640 | 4/1974 | Ericson | 2/114 |

FOREIGN PATENT DOCUMENTS

| | | | |
|---|---|---|---|
| 382,129 | 11/1907 | France | 2/114 |
| 27,546 of | 1905 | United Kingdom | 2/DIG. 2 |

*Primary Examiner*—Werner H. Schroeder
*Assistant Examiner*—Moshe I. Cohen

[57] ABSTRACT

A reversible, back opening surgical gown, capable of enclosing the wearer from neck to mid calf exposes a "surigically clean" or "sterile" exterior surface. The gown, because of its symmetry, is capable of exposing either of its fabric surfaces as its exterior sterile surface when enveloping the body of a wearer. As such, it avoids the necessity of reversing the gown, as in a laundry, after use, to expose a usable exterior surface, required by conventional asymmetric gowns.

11 Claims, 11 Drawing Figures

REVERSIBLE SURGICAL GOWN

This is a continuation-in-part application to that filed Oct. 23, 1975, as Ser. No. 625,229, now abandoned.

This invention relates to a surgical gown and more particularly to a reversible surgical gown adapted for use in surgical and medical procedures.

BACKGROUND TO INVENTION

There is a plurality of surgical gowns presently available. Each has its own distinctive advantages for the purposes for which it was designed. Many prior art gowns incorporate a one piece front, sleeves with expandable cuffs, a back which opens full length to facilitate donning and doffing. The back opening is usually located at the centre back and is closed about the wearer with a number of fastenings such as tie tapes. During fastening, these tapes may become contaminated by the unclean attendant or by contact with the wearer's underclothing or body. To ensure a completely sterile exterior surface, a full length back overflap is provided. Such a flap is kept "clean" during donning by being secured to a "clean" area at the front of the gown. Once the gown is closed at the back, the flap is then wrapped over the tie tapes, around the back of the wearer to overlap these tapes and thus enclose the contaminated area of the back and to expose along the back an exterior sterile surface.

After the surgical or operative procedure is performed the attendants assist in removal of the used gown from the wearer. After the back flap is loosened and the tie tapes untied, one of the attendants pulls the gown by the collar from beneath the chin of the wearer, forward and downward, smartly, away from the wearer. The gown, having generally expandable cuff means at the sleeve terminals, urging against the wrists of the wearer, resists total removal from the wearer until the body of the gown has been removed away from the wearer to such an extent that the sleeves of the gown have been turned inside out and are taut; whereupon, further pulling, the cuffs expand to slide over the hands and the gown is removed. This removeable action effectively turns the gown inside out.

The exterior of the gown, which during the surgical or operative procedure will have become contaminated as with patient blood, saline solution, etc., if "folded" into the interior of the removed gown so that the used gown may be rolled up conveniently with its former interior (the unsoiled surface) as the exterior and the contaminents inside. The gown is then placed in the bag for return to the laundry, without contaminating the wearer, the attendants, or the laundry staff.

PRIOR ART

Although many surgical gowns exist which to a greater or lesser extent accommodate the above functions, such gowns are asymmetric; therefore, it is ultimately necessary that the gowns be re-reversed before reuse. This re-reversal generally takes place during laundering operations and hence increases the labour costs involved in laundering surgical gowns.

Gowns of the prior art have been adopted, notwithstanding they require re-reversal after each use, because a sterile exterior surface about the wearer is achieved.

With increasing labour costs in laundering operations, total operating costs and hence unit laundering costs, could be effectively reduced if the need to re-reverse the gown could be avoided.

It is an object of the present invention to provide a gown which may be worn with either side as its exterior; and particularly a reversible gown which may be worn either with one side as its exterior or the obverse surface as its exterior.

This object is achieved by providing essentially a symmetrical gown.

It is a further feature of the invention to provide a gown, which upon removal from the wearer, need not be reversed, so that laundering, folding, packaging and sterilization may take place without this labour absorbing function.

The invention, therefore, contemplates a surgical gown having a front, a back with fastening devices along the back, and additional back flaps symmetrically located. The gown, because of its general symmetry, is capable of exposing either of its fabric surfaces as its exterior surface when enveloping the body of a wearer. As such it avoids the requirement to reverse the gown, after an earlier use, to expose a usable exterior surface, as required by conventional asymmetric gowns.

The invention now achieves a reversible surgeon's gown, comprising:

a front panel having an upper margin, first and second front panel side margins and a collar bordering the upper margin;

a first back panel extending laterally from said first front panel side margin and having a first back panel side margin;

a second back panel extending laterally from said second front panel side margin and having a second back panel side margin;

a first back flap extending laterally from said first back panel side margin and terminating in a first distal side edge;

a second back flap extending laterally from said second back panel side margin and terminating in a second distal side edge;

a first sleeve member attached between said front panel and said first back panel;

a second sleeve member attached between said front panel and said second back panel;

first retaining means attached on one surface of the gown at the said first distal side edge;

second retaining means attached on the obverse face of the gown at the second distal side edge;

third retaining means attached to the front panel on both surfaces of the gown near the first front panel side margin;

fourth retaining means attached to the front panel on both surfaces of the gown near the second front panel side margin; said first retaining means adapted to secure to said fourth retaining means and to thereby hold the second back flap over and behind the back of the wearer; and said second and third retaining means adapted to secure first back panel over the second back panel.

The invention also contemplates a reversible surgeon's gown, comprising:

a front panel having first and second front panel side margins;

a first back panel extending laterally from said first front panel side margin and having a first back panel side margin;

a second back panel extending laterally from said second front panel side margin and having a second back panel side margin;

a first back flap extending laterally from said first back panel side margin and terminating in a first distal side edge;

a second back flap extending laterally from said second back panel side margin and terminating in a second distal side edge;

a first sleeve member attached between said front panel and said first back panel;

a second sleeve member attached between said front panel and said second back panel;

first securing means attached at said first back panel side margin on one surface of said gown;

second securing means attached at said second back panel side margin on the opposite surface of said gown, said first and second securing means being adapted to secure said first back panel side margin to said second back panel side margin to provide secured first and second side margins at the back of the wearer;

first retaining means attached at said first distal side edge;

second retaining means attached at said second distal side edge;

third retaining means attached on said front panel on said one surface of the gown; and fourth retaining means attached on said front panel on said opposite surface of the gown, said first and fourth retaining means being adapted to retain said first back flap over said secured first and second back panel side margins when said opposite surface is the outside surface of the gown, and said second and third retaining means being adapted to retain said second back flap over said secured first and second back panel side margins when said one surface is the outside surface of the gown.

The embodiment of the invention will now be described by way of example and reference to the accompanying drawings in which.

Figure 7:
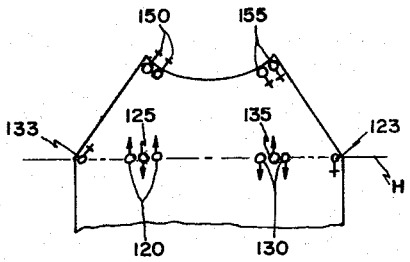
FIG. 7 is a diagrammatic representation of male/-female fastener positions and the surfaces on which they are placed, for an alternative embodiment.
Figure 9:
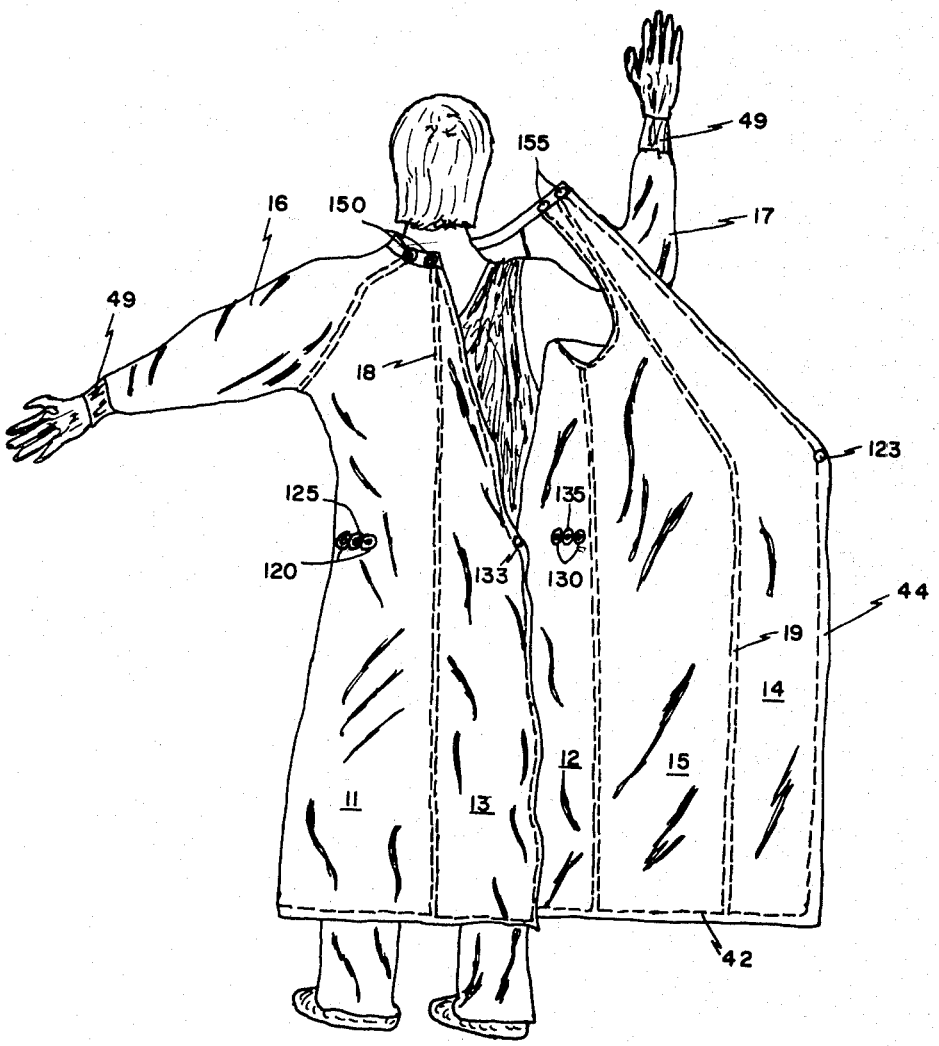

FIGS. 8 through 11 correspond to FIGS. 1 through 4 respectively for the alternative embodiment of FIG. 7.

Figure 1:
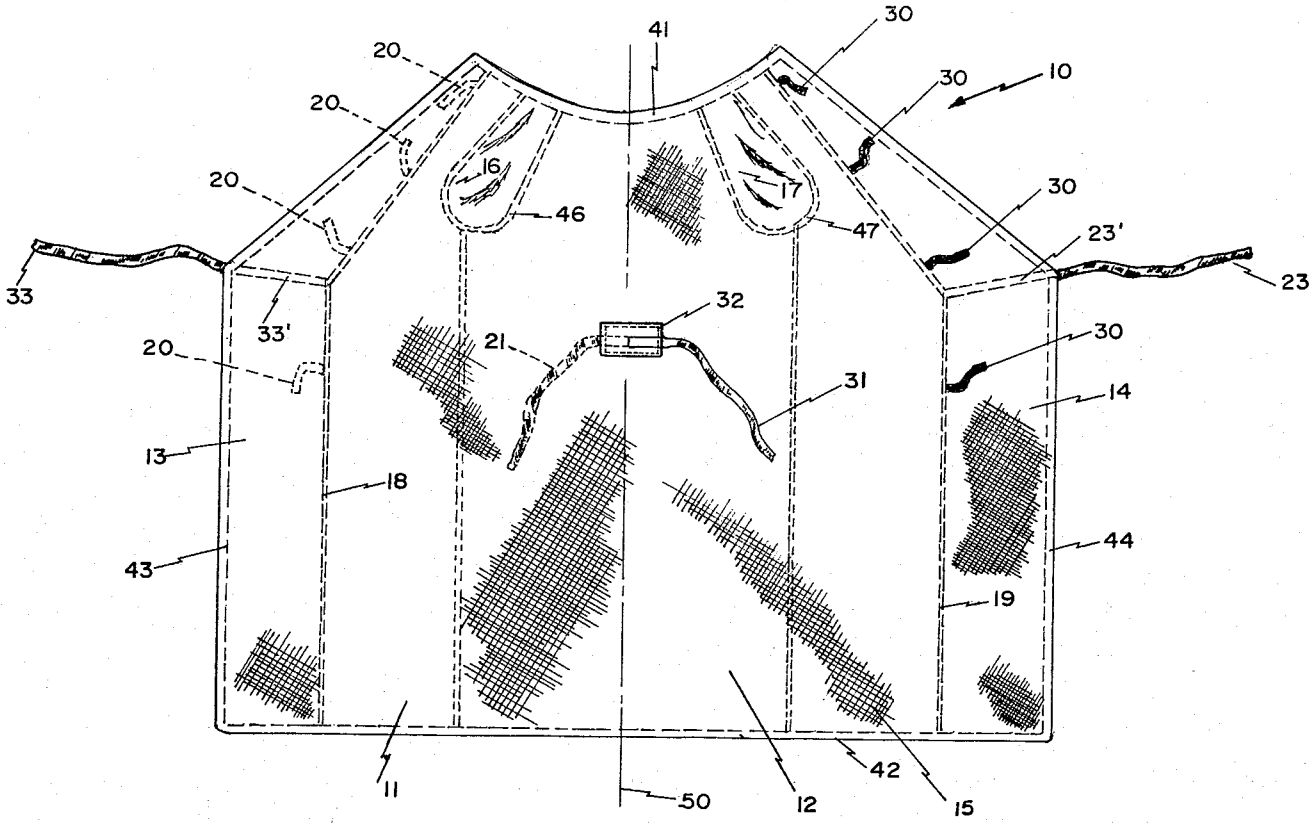
FIG. 1 is a plan view of an embodiment of the gown.
Figure 2:
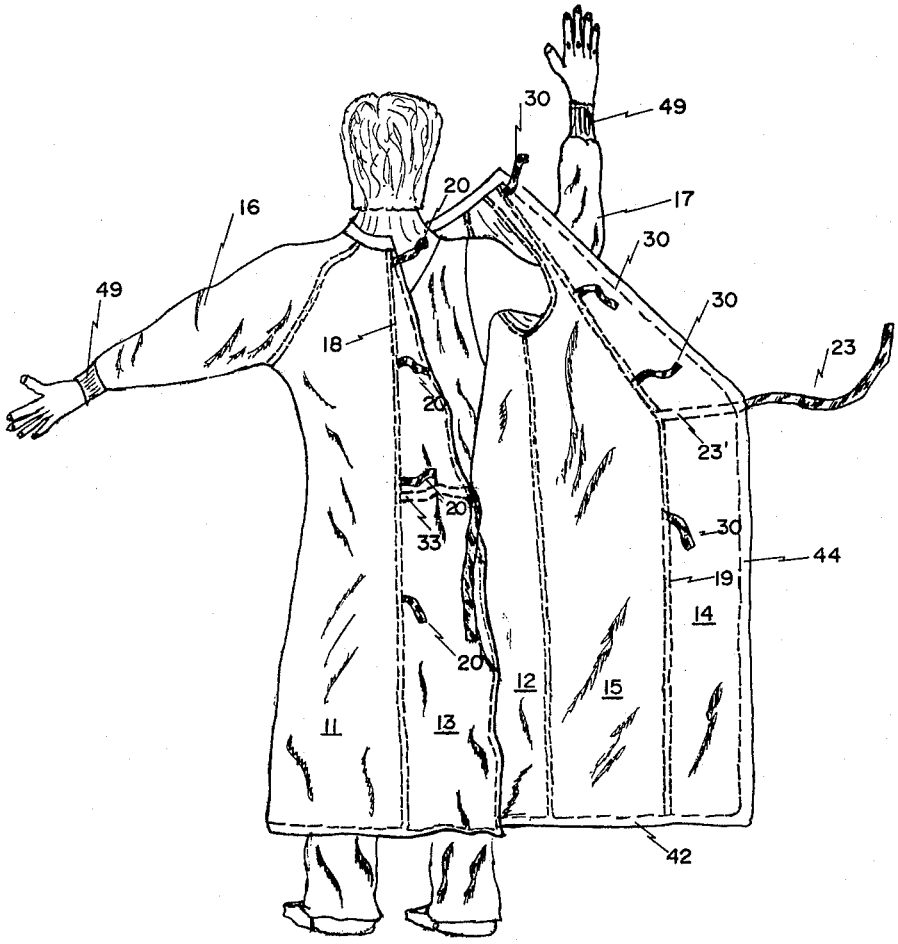
FIG. 2 is a back respective view of the gown being put on the wearer (the attendant not shown).
Figure 3:
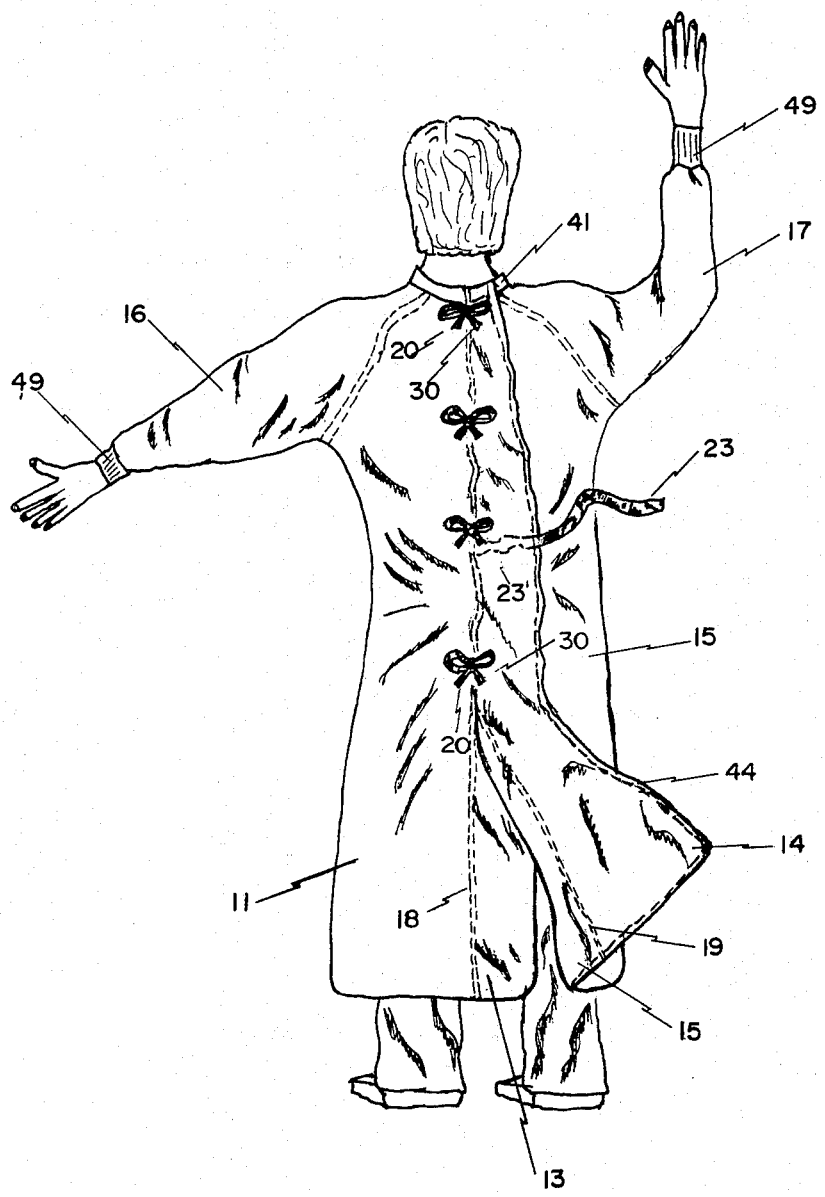
FIG. 3 is a perspective of FIG. 2 showing the back tapes tied.

Referring to FIG. 1 a symmetrical gown 10 for surgical and operative procedures includes a body portion formed from a seamless piece of material such as cloth or disposable paper. The body portion includes a front panel 12 extending into left and right back panels 11 and 15 which define respectively proximate margins 18 and 19. Left and right sleeve portions 16 and 17 are attached at the proximate sleeve ends to the upper portion of the front panel 15 at the juncture with the back panel. The back flap panels 13 and 14 are attached to the back panels 11 and 15 along respective approximate margins 18 and 19. All attachments are made as by sewing, gluing or other acceptable means of attachment. In order to provide means to secure the gown on the wearer, a set of left back panel tapes 20 are attached along the front proximate margin 18 on one face of the gown 10, while right back panel tapes 30 are attached to the proximate margin 19 on the obverse face of the gown.

In order to provide means for securing the back flap over the tapes 20 and 30, when engaged, waist ties 21, 23, 31 and 33, are also provided. A pair of ties, central waist ties 21 and 31 are mounted on one and the obverse faces of the body of the gown 10 in a central waist region and hence central of the front panel 12 at waist elevation. In order to ensure that the central waist ties do not pull away from the front panel 12, a stress patch 32 is attached onto one surface of the front panel 12 (FIG. 1) and the central waist tie 21 attached to it. The obverse central waist tie 31 is secured to the obverse surface of the front panel 12 and stitched through the stress patch 32.

Figure 4:
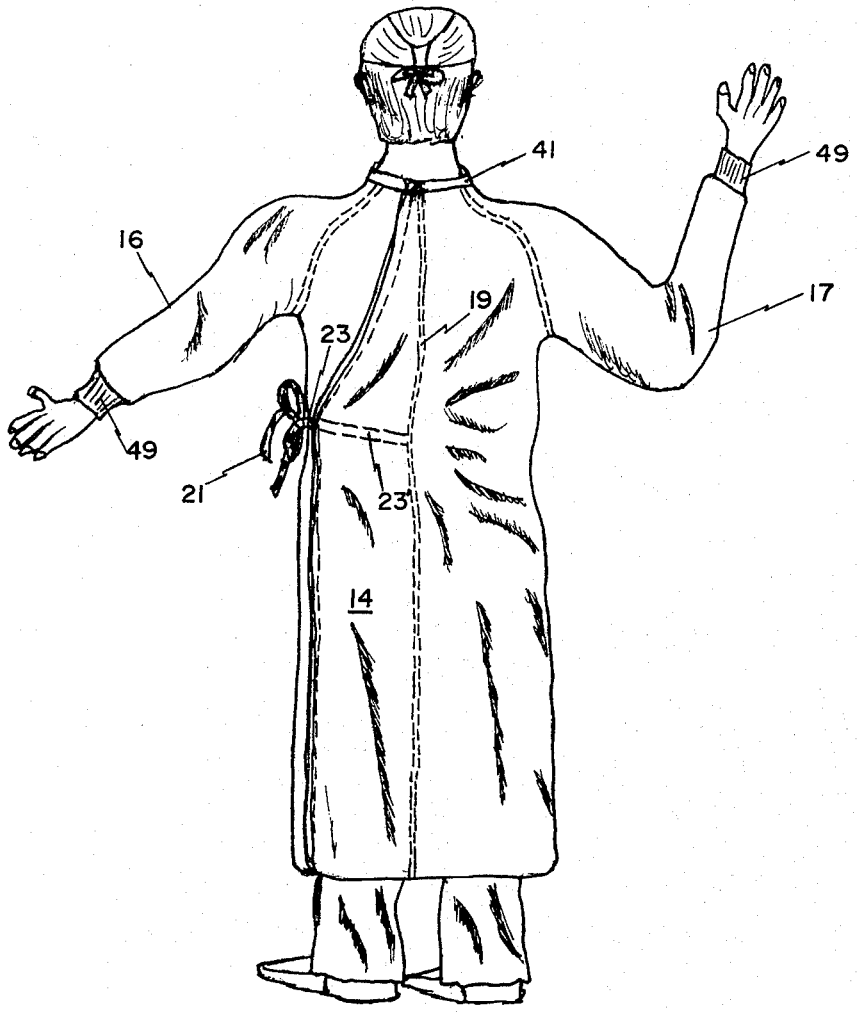
FIG. 4 is a perspective back view of FIG. 2 with a gown completely closed and belted.
Figure 5:
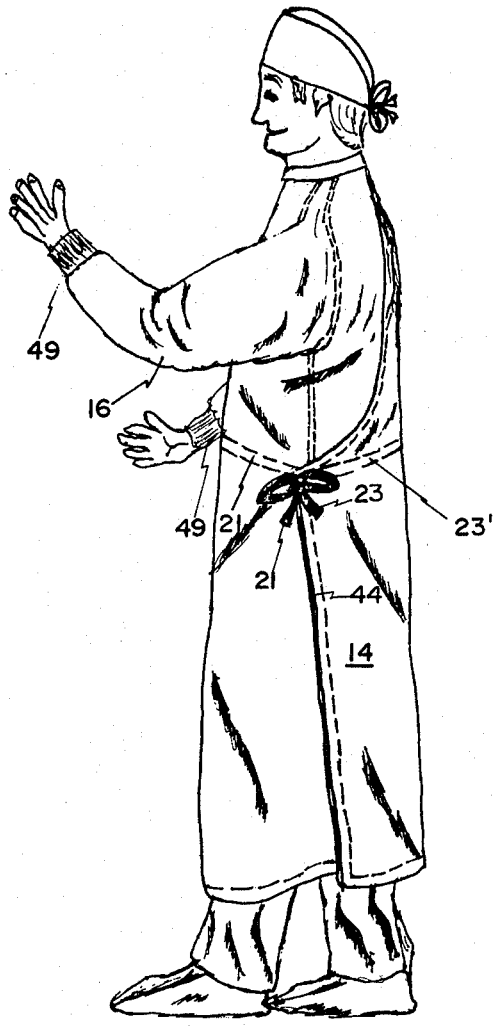
FIG. 5 is the perspective view of (FIG. 4) the gown completely closed and belted.
Figure 6:
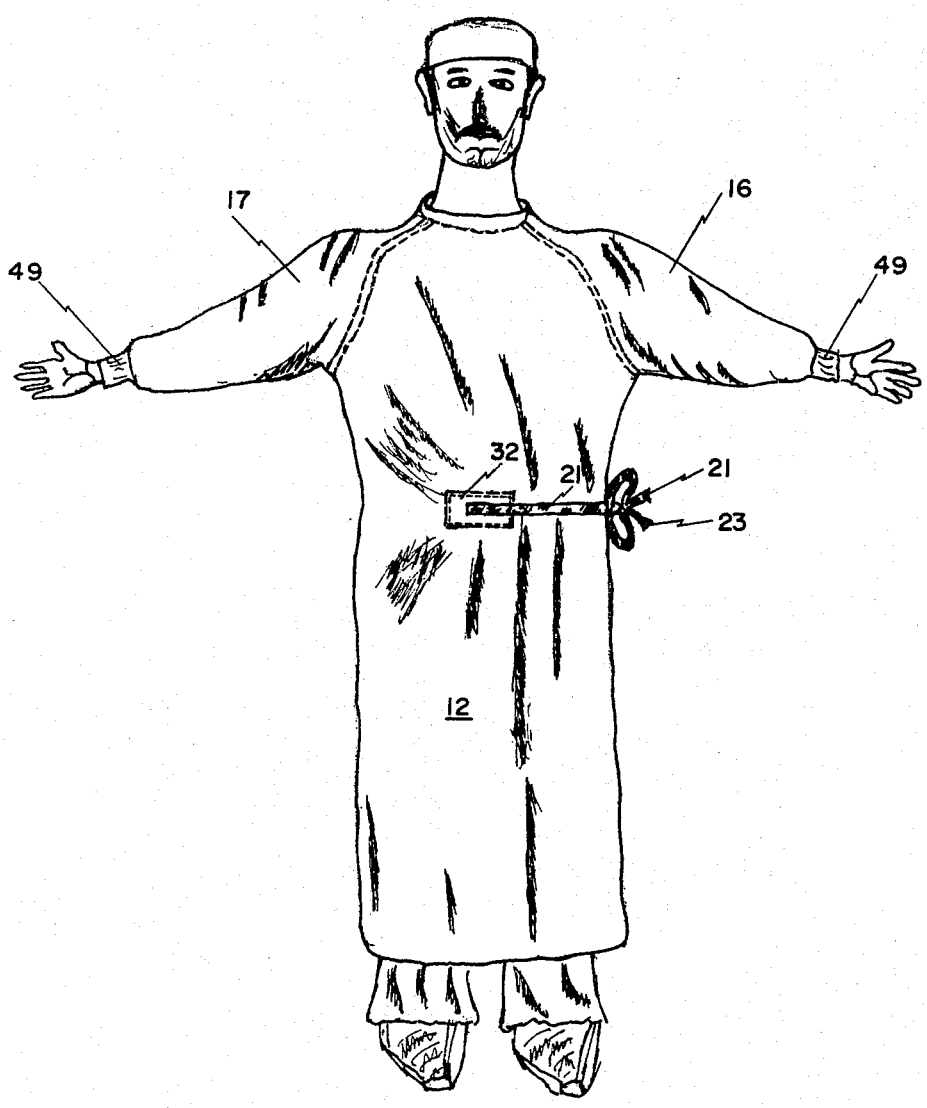
FIG. 6 is a perspective front view to that of FIG. 5, the gown completely donned and belted about the wearer.

There are two marginal or distal waist ties 23 and 33. One is attached to a distal margin of the left back flap 13, in line with the imaginary horizontal line through the stress patch 32, while the other distal waist tie 23 is attached to the distal margin of the right back flap 14 on the same imaginary horizontal line. As will be explained one central and one distal waist tie will be tied, at the completion of donning, to belt the gown about the wearer, as is shown in FIGS. 4, 5 and 6. This ensures, firstly, that the exposed back flap, which in FIGS. 2 through 5 is the right back flap 14, envelopes the back tapes 20 and 30, to expose only a smooth sterile exterior surface over the back of the body of the gown 10; and secondly, that due to the pull on the exterior waist tie (tie 21 of FIGS. 5 and 6), of the central distal waist tie 23, the front panel 12, is tucked tightly against the body of a wearer, after belting, to keep the gown snug to the wearer's body and away from the sterile work area.

Although we have not found it necessary, in some applications it may be useful that additional anchorage be provided for the distal waist ties 23 and 33. This could exist as by an extension of those ties through the back flap as a folded material strip 23' and 33' respectively.

Now referring to FIGS. 2 through 6, the distal end of each of the sleeve portions 16 and 17, respectively terminate at a cuff 49 (knit cuff) which acts as a defensive cuff means, providing snug fit at the wrist, suitable to accepting surgical gloves to complete the sterile field. There is an additional advantage to such a knit cuff 49, on removal of the gown from the wearer. The cuff, which urges about the wrists of the wearer, ensures that, on removal, as the body portion of the gown is pulled away, forward and downward, from the wearer, the sleeve portions will turn inside out; and on further pulling, the cuff means will ride over the wrists and off the wearer. This action ensures that the gown, is reversed in concert with the removal of the gown.

It should be noted, by way of caution, that those skilled in the art will appreciate, that the figures representing the "donning" of the gown (FIGS. 2, 3 and 4) do not actually illustrate a typical scrub room donning, for the right back flap 14 is actually folded over the right portion of the front panel 12 and secured there by the distal waist tie 23 fastening to the central waist tie 21 (this is not shown). After the back tapes 20 and 30 are respectively tied to each other by the unclean nurse as at FIG. 3, to secure the gown on the wearer, the waist ties 21 and 23 are untied by the sterile nurse and right back flap 14 is "walked around" to lay it over the tied back tapes 20 and 30 as at FIG. 4. The waist ties 21 and 23 are then retied about the opposite (left) side of the wearer by the sterile nurse. The overlaying of the back right flap 14, over the back tie tapes 20 and 30, assures isolation of the unsterile back regions of the wearer, which had been exposed during donning.

When the central region (not shown) of the front panel 12 is an impervious region as when fabricated of liquid repellent fabric or a fabric of tighter weave, the location of the front waist tie 31 and 21 can be at the lateral margins of this impervious region, rather than at the central region as shown in the drawings; otherwise, the impervious regions would be punctured during the sewing of the stress patch 32 and the full benefits of an impervious region would not be achieved. This configuration of our invention has a disadvantage, however; that is on belting, the front panel 12 is not tucked in against the body of the wearer to the same extent as it would if the central waist ties were centrally anchored as illustrated in FIGS. 1 through 6.

It will be apparent to those skilled in the art, that the function of the gown would be equally effective with an alternative fastening for the back and flaps; such as metal or plastic snap fasteners, or pile-hook tape fasteners; the latter commonly known under the trade mark VELCRO, a trade mark of VELCRO Corporation, New York, New York, U.S.A.

It will also be apparent that for surgical applications, there should not be any raw edges of the gown material or cuff material; thus, collar seams 41 and hem 42 as well as marginal seam 43 and 44 and all other internal seams must enclose all raw edges of the material in the seam itself. Typical seams which achieve this result include a French seam, a two needle felled seam and the like.

Referring to an alternative embodiment, and FIGS. 7 through 11; FIGS. 8 through 11 correspond to FIGS. 1 through 4 for this alternative. The ties of FIGS. 1 through 4, which act as the securing means and retaining means respectively, are generally replaced with mating male and female dome fasteners, in the embodiment shown in FIGS. 7 through 11. Particularly, the distal ties 23 and 33 are respectively replaced with oppositely facing identical fastening members. For instance, a (female) fastener (123) is disposed at one distal margin (the right distal margin 44) on one face of the gown (this is the face displaying its surface to the viewer as viewed in FIG. 8), while an identical fastener (female fastener 133) is attached at the opposite distal margin; namely, left distal margin 33, but on the obverse face of the gown (that face as seen from behind the viewable plane of FIG. 8).

Waist ties 21 and 31 of the embodiment of FIGS. 1 through 6 are abolished and thus there is no need for the stress patch 32. Instead, the spatially disposed tapes 20 and 30 (of FIGS. 1 through 6) are replaced, with strategically placed fasteners. For example, fasteners are located on the front panel 12, on both front and obverse surfaces, but adjacent each of the lateral back panels 11 and 15. Thus a male dome fastener 120 and 135 is diposed on one face of the gown, near the respective lateral margins. while another male dome fastener (fasteners 125 and 130) of a different set are disposed on the obverse face of the gown near the respective lateral margins. Duplication of male fasteners 120 and 130 is for gown waist adjustability as will become apparent hereafter.

Figure 8:
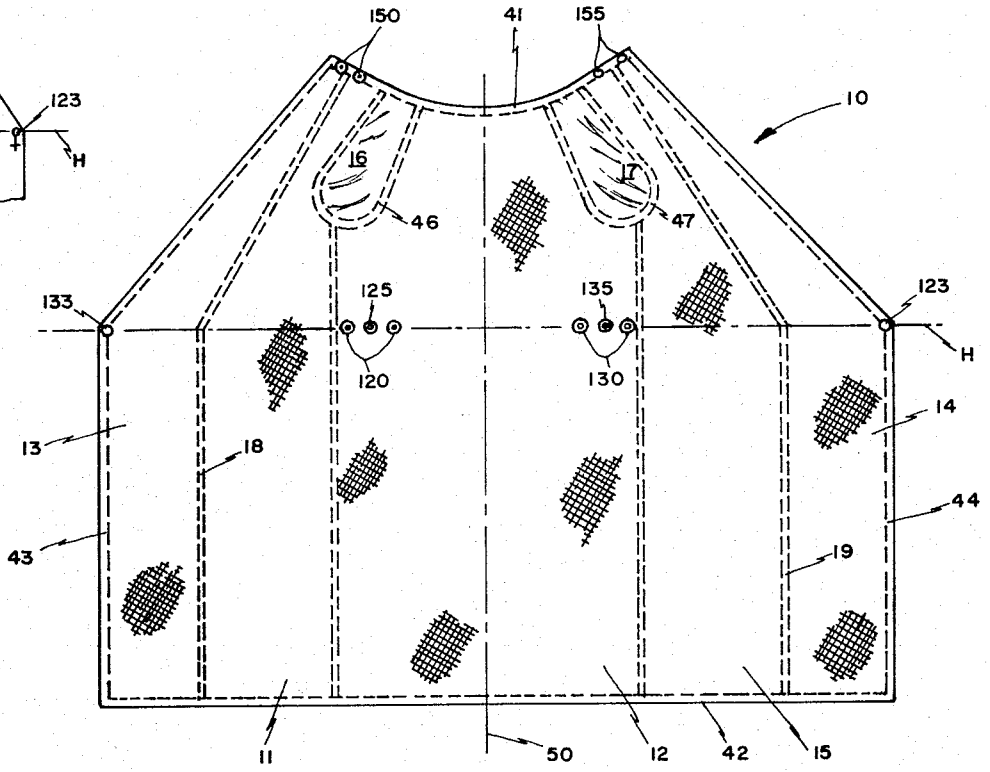

On the collar 41 there is mounted a female dome fastener 155 at one end, on the frontal surface (as viewed in FIG. 8) and a male dome fastener 155 at the other end of the collar but on the obverse face of the gown (the number as viewed from behind the viewable plane of FIG. 8). These fasteners 150 and 155 are paired, or duplicated, so as to permit adjustability of the collar length around the wearer. (FIG. 7 indicates, symbolically, the positioning and disposition of the respective male and female dome fasteners as shown in FIG. 8. The upright symbols illustrate the disposition of the kind of fastener facing the viewer as seen in FIG. 8, while the upside down symbols indicate the corresponding fastener on the obverse face of the gown — that is on that surface of the gown obverse from view in FIG. 8.)

Figure 10:
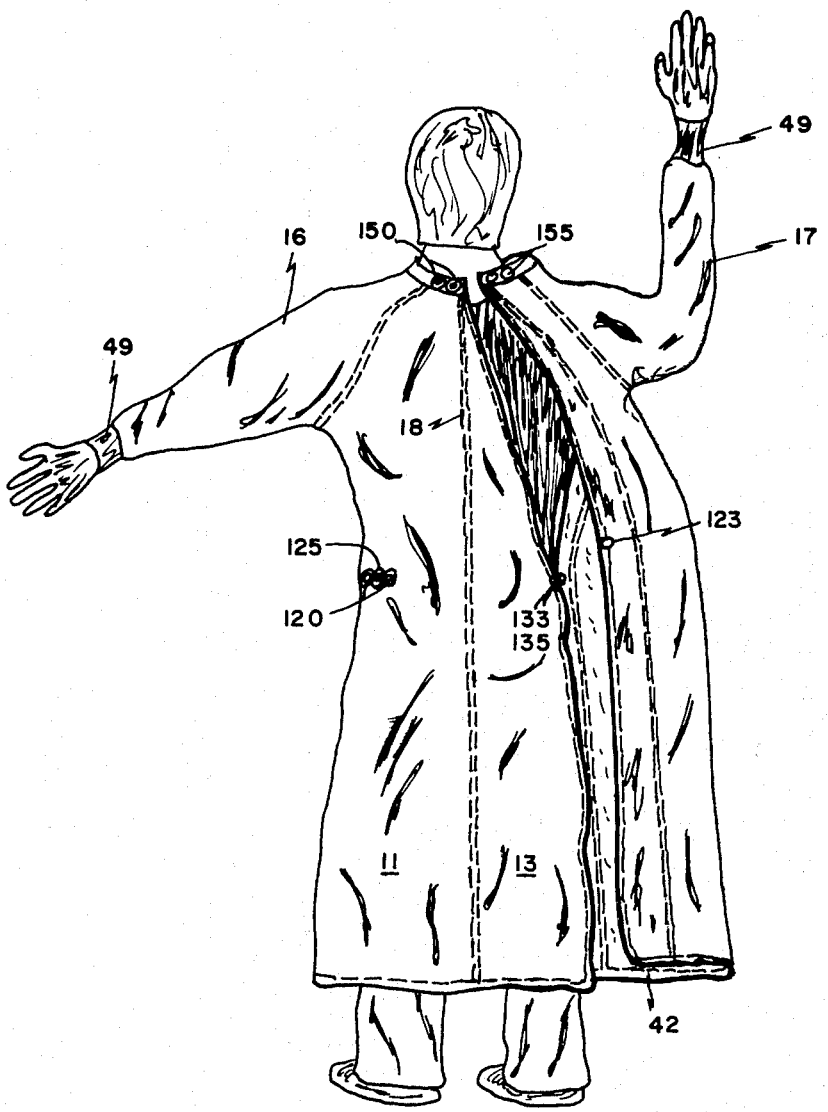
Figure 11:
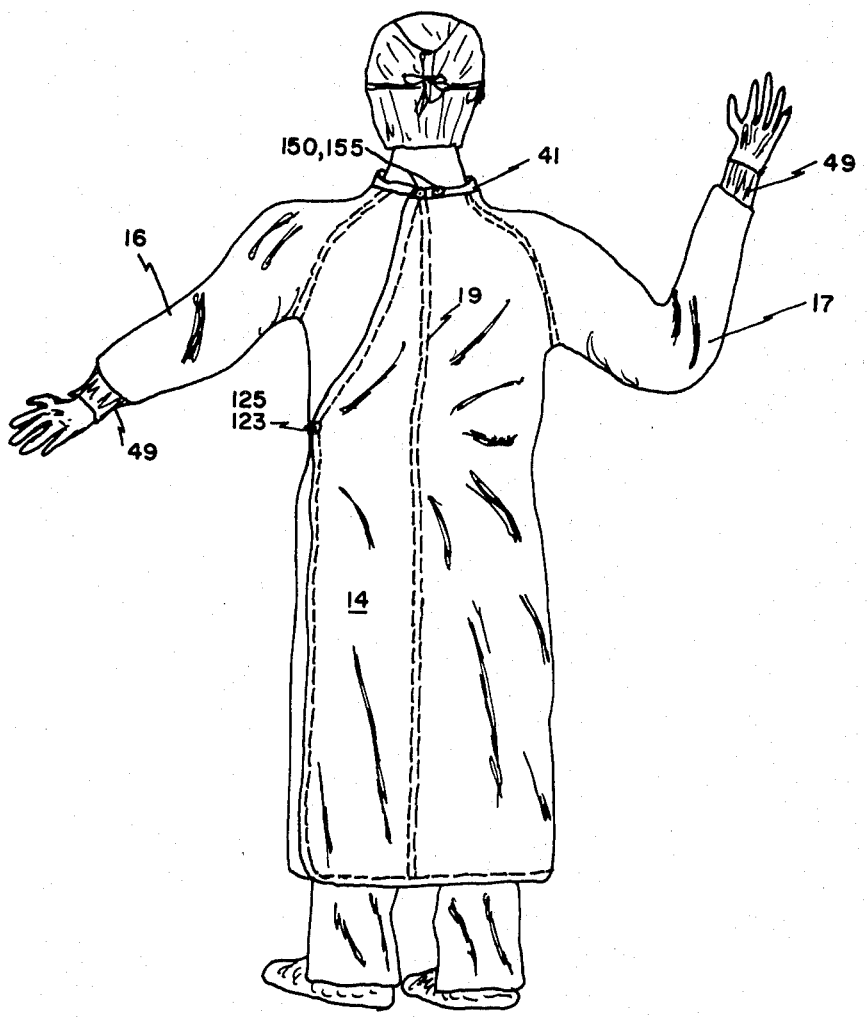

The gown of FIG. 8 (FIGS. 7 through 11) is donned in a similar manner to the gown of FIGS. 1 through 6. Thus, referring to FIG. 9, prior to the initial donning procedure, and while in the laundry, one of the back flaps, ie. right back flap 14 in FIGS. 8 and 9 has been secured to the front of the gown (not shown) by engaging the female dome fastener 123 onto the male dome fastener 135 over the obverse face of the right portion of the front panel of the gown. During donning, in the scrub room, the collar is placed around the neck of the wearer and the collar dome fasteners 150 and 155 are mated. The collar length for the wearer is adjustable by reason of the duplication of the fasteners 150 and 155. Then, the female dome fastener 133 located on the left distal margin 43 of the left back flap 13 is mated with one of the male dome fasteners 130 to secure the distal margin of the left back flap 13 behind the back of the wearer. The right back panel 15 is now ready to be folded and to overlay the left back panel 11 so as to isolate the contaminated back area of the wearer. This is achieved by first unmating the female dome fastener 123 from its mating male 135 and then reverse folding the right back flap 14 (and panel 15) over the secured left back flap 13 (and panel 11) and securing the female dome fastener 123 to the male 125 located on the left side of the front panel of the wearer. The gown is thus secured about the wearer as shown in FIG. 10.

As earlier explained, the duplication of the fasteners 120 and 130 is for adjustability of the waist length about the wearer as is now clearly apparent. The collar length, is adjustable by reason of the duplication of fasteners 150 and 155. For adequate reversibility, without adjustability, only one of each of the fasteners 120, 130, 150, 155 need be used. For greater adjustability additional such fasteners are required.

It will now become apparent, that where male dome fasteners are used female dome fasteners are used. Further, it is now apparent, that other securing means could adequately be used rather than the dome fasteners; for example the VELCRO fasteners, or button holes with mating buttons.

We claim:

1. A reversible surgeon's gown, comprising:

a front panel having first and second front panel side margins;

a first back panel extending laterally from said first front panel side margin and having a first back panel side margin;

a second back panel extending laterally from said second front panel side margin and having a second back panel side margin;

a first back flap extending laterally from said first back panel side margin and terminating in a first distal side edge;

a second back flap extending laterally from said second back panel side margin and terminating in a second distal side edge;

a first sleeve member attached between said front panel and said first back panel; a second sleeve member attached between said front panel and said second back panel;

first securing means attached at said first back panel side margin on one surface of said gown;

second securing means attached at said second back panel side margin on the opposite surface of said gown, said first and second securing means being adapted to secure said first back panel side margin to said second back panel side margin to provide secured first and second side margins at the back of the wearer;

first retaining means attached at said first distal side edge;

second retaining means attached at said second distal side edge;

third retaining means attached on said front panel on said one surface of the gown; and fourth retaining means attached on said front panel on said opposite surface of the gown, said first and fourth retaining means being adapted to retain said first back flap over said secured first and second back panel side margins when said opposite surface is the outside surface of the gown, and said second and third retaining means being adapted to retain said second back flap over said secured first and second back panel side margins when said one surface is the outside surface of the gown.

2. A reversible gown as claimed in claim 1, wherein said first and second securing means comprise pluralities of ties vertically spaced at corresponding positions along said first and second side panel side margins, respectively.

3. A reversible gown as claimed in claim 1, wherein said third and fourth retaining means are attached to opposite surfaces of the center of said front panel.

4. A reversible gown as claimed in claim 1, wherein said first, second, third, and fourth retaining means are ties of sufficient length to be tied at the side of the wearer.

5. A reversible gown as claimed in claim 1, wherein said front panel is attached to said first back panel by a seam at said first front panel side margin and to said second back panel by a seam at said second front panel side margin, and wherein said first back panel is attached to said first back flap by a seam at said first back flap side margin and said second back flap is attached to said second back flap by a seam at said second back flap side margin.

6. A reversible gown as claimed in claim 1, wherein said first and second back panels and said first and second back flaps are substantially symmetrical.

7. A reversible surgeon's gown, comprising:

a front panel having an upper margin, first and second front panel side margins and a collar bordering the upper margin;

a first back panel extending laterally from said first front panel side margin and having a first back panel side margin;

a second back panel extending laterally from said second front panel side margin and having a second back panel side margin;

a first back flap extending laterally from said first back panel side margin and terminating in a first distal side edge;

a second back flap extending laterally from said second back panel side margin and terminating in a second distal side edge;

a first sleeve member attached between said front panel and said first back panel;

a second sleeve member attached between said front panel and said second back panel;

first retaining means attached on one surface of the gown at the said first distal side edge;

second retaining means attached on the obverse face of the gown at the second distal side edge;

third retaining means attached to the front panel on both surfaces of the gown near the first front panel side margin;

fourth retaining means attached to the front panel on both surfaces of the gown near the second front panel side margin; said first retaining means adapted to secure to said fourth retaining means and to thereby hold the second back flap over and behind the back of the wearer; and said second and third retaining means adapted to secure first back panel over the second back panel.

8. The reversible surgeon's gown as claimed in claim 7 wherein the first and second retaining means are male dome fasteners and the third and fourth retaining means are female dome fasteners.

9. The reversible surgeon's gown as claimed in claim 7 wherein the first and second retaining means are female dome fasteners and the third and fourth retaining means are male dome fasteners.

10. The reversible surgeon's gown as claimed in claim 7 wherein the third retaining means is positioned adjacent the first front panel side margin and the fourth retaining means is positioned adjacent the second front panel side margin.

11. The reversible surgeon's gown as claimed in claim 7 wherein the retaining means are hook and loop fasteners.

* * * * *